US006494590B1

(12) United States Patent
Paganini et al.

(10) Patent No.: US 6,494,590 B1
(45) Date of Patent: Dec. 17, 2002

(54) POWER TOOLS HAVING LIGHTING DEVICES

(75) Inventors: Mauro Paganini, Borgoticino (IT); Giorgio Paganini, Borgoticino (IT)

(73) Assignee: Makita Corporation, Aichi-Ken (JP)

( * ) Notice: Subject to any disclaimer, the term of this patent is extended or adjusted under 35 U.S.C. 154(b) by 0 days.

(21) Appl. No.: 09/628,928

(22) Filed: Jul. 28, 2000

(30) Foreign Application Priority Data

Jul. 30, 1999 (IT) ..... MI99A1722

(51) Int. Cl.[7] ..... B25B 23/18

(52) U.S. Cl. ..... 362/119; 362/109; 362/119; 362/120; 362/276; 362/802; 362/295; 408/16; 83/520

(58) Field of Search ..... 362/109, 276, 362/802, 119, 295, 120; 408/16; 83/520

(56) References Cited

U.S. PATENT DOCUMENTS

| | | | | |
|---|---|---|---|---|
| 3,919,541 A | | 11/1975 | Chao | |
| 3,977,278 A | | 8/1976 | Jackson | |
| 4,587,459 A | | 5/1986 | Blake | 315/158 |
| 5,169,225 A | | 12/1992 | Palm | |
| 5,285,708 A | | 2/1994 | Bosten | 83/520 |
| 5,473,519 A | | 12/1995 | McCallops et al. | |
| 5,634,711 A | * | 6/1997 | Kennedy et al. | 362/119 |
| 6,175,196 B1 | * | 1/2001 | Ragner et al. | 315/200 A |
| 6,318,874 B1 | | 11/2001 | Matsunaga | |

FOREIGN PATENT DOCUMENTS

| | | |
|---|---|---|
| DE | 2529668 | 1/1977 |
| DE | 8521614.3 | 2/1986 |
| DE | 3738563 | 5/1989 |
| DE | 3831344 | 3/1990 |
| FR | 2523891 | 9/1983 |
| GB | 2305128 | 4/1997 |
| JP | 6098602 | 7/1985 |
| JP | 2512328 | 8/1991 |
| JP | 11170203 | 6/1999 |
| WO | 99/02310 | 1/1999 |

OTHER PUBLICATIONS

U.S. patent application Ser. No. 09/570,035, filed May 12, 2000.

U.S. patent application Ser. No. 09/835,495, filed Apr. 17, 2001.

Japanese catalog published Apr. 1988 by Hitachi Koki Kabushiki Kaisha.

Claims of U.S. patent application Ser. No. 09/954,381 (Divisional of 6,318,874).

U.S. patent application Ser. No. 09/605,517, Matsunaga, filed Jun. 28, 2000.

* cited by examiner

*Primary Examiner*—Sandra O'Shea
*Assistant Examiner*—Guiyoung Lee
(74) *Attorney, Agent, or Firm*—Dennison, Schultz & Dougherty

(57) ABSTRACT

Lighting devices are taught for machine tools. The lighting devices may include one or more light emitters controlled by an electric circuit, which can be connected via one or more conductors to the inner circuit of an electric machine tool. The electric circuit may comprise at least one photometer and a controller that automatically controls the illumination level of the light emitters in response to the ambient light intensity detected by the photometer. The present invention also relates to machine tools comprising such lighting devices.

35 Claims, 3 Drawing Sheets

POWER TOOLS HAVING LIGHTING DEVICES

TECHNICAL FIELD

The present invention relates to electric tools having lighting devices, and in particular, to portable electric drills and screwdrivers having lighting devices. Such lighting devices permit the operator to illuminate the working area in accordance with ambient light levels. The present invention also relates to lighting devices that can be utilized, for example, in machine tools.

DESCRIPTION OF THE RELATED ART

German Patent No. 3831344 discloses a portable drill having a lighting device comprising a plurality of light emitting diodes (LEDs), which are suitable to illuminate the working area. These LEDs are powered and controlled by the same electric power supply and motor control means of the machine tool.

SUMMARY OF THE INVENTION

However, when the ambient light intensity is high, the light from the lighting device may be too bright and may possibly stun the operator if the operator looks into the light. Further, if lighting device shines even though the ambient light intensity is already sufficient to light the work area, energy will be wasted, which is disadvantageous for battery powered tools.

Therefore, it is an object of the present invention is to provide a lighting device that overcomes these problems and can be utilized in power tools, and in particular in portable drills and screwdrivers.

In one aspect of the present teachings, a power tool is taught that has a light adapted to illuminate a work area, an ambient light sensor and a controller adapted to change the intensity of the light based upon the ambient light conditions detected by the sensor. As a result, the controller can automatically turn the light on and off depending upon ambient light conditions. Further, the controller may also be adapted to adjust the intensity of the light based upon the ambient light conditions in an inversely proportional manner. Preferably, the light is supplied by light emitting diodes (LEDs).

The tool may further include circuits for improving the efficiency of the tool and to reduce the energy consumption of the tool. A delay circuit may be provided to delay turning off the light emitting diodes, so as to continue to illuminate the working area for a period of time after the motor of the power tool has stopped.

Due to its simplicity, the present teachings can be incorporated both into existing tools as well as into newly conceived power tools. Embodiments are taught that provide an advantageous shape for a printed circuit that holds the sensor and a printed circuit protection cap. In addition, a voltage limiting circuit is taught that permits the present teachings to be utilized with several different kinds of power tools, irrespective of the supply voltage.

Further advantages and features of the lighting device according to the present invention will be evident to those skilled in the art front the following detailed description of an embodiment thereof with reference to the attached drawings.

DETAILED DESCRIPTION OF THE INVENTION

Lighting devices are taught for machine tools. One or more light emitters may be controlled by signals output from at least one light detector (also, referred to as a sensor or photometer in this specification). Means also may be provided to automatically control the lighting of the light emitters in accordance with ambient light conditions detected by the light detector. The control means may include a sensor circuit having at least one photodiode adapted to adjust the light intensity of said light emitters. This sensor circuit may be connected to a modulator circuit that is adapted to modulate the lighting frequency of the light emitters according to the light intensity sensed by said photometer. The modulator circuit may be connected to a buffer memory circuit, which is connected to one or more on/off circuits, each of which may comprise one or more transistors adapted to control the turning on and off of said light emitters.

The control circuit may include a terminal adapted to connect the switch of the machine tool to the light emitters in accordance with the voltage sensed at said terminal. The control circuit may also include a delay circuit coupled to the light emitters, which delay circuit will cause the light emitters to continue to shine after the power supply to the motor has stopped. In addition, the controller may include a voltage limiting circuit adapted to regulate the voltage of the electric power source.

The control circuit may be disposed on a printed circuit board that has a substantially annular shape. The light emitters and the light sensor may be disposed on the printed circuit board. A protective cap, which is adapted to be attached to the casing of the power tool, may be provided with a plurality of holes for the light emitters and the light sensor. The printed circuit board is preferably disposed between the cap and the casing.

The light emitters may be one or more light emitting diodes or other light sources, such as incandescent lights.

A representative example of the present teachings will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detail description may not be necessary to practice the invention in the broadest sense, and are instead taught merely to particularly describe representative examples of the invention.

Figure 1:
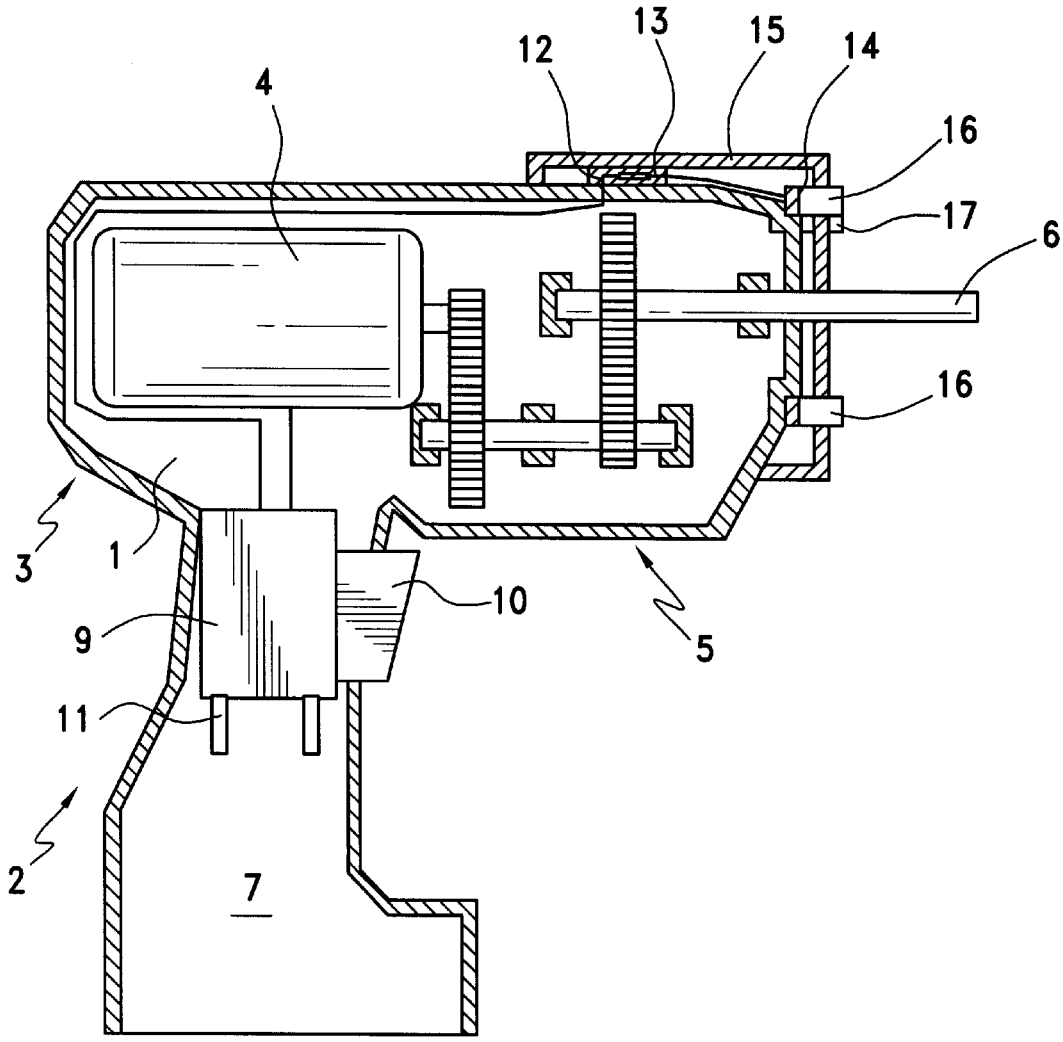
FIG. 1 shows a schematic cross-sectional, lateral view of an electric drill provided with the lighting device according to a first representative embodiment.
Figure 2:
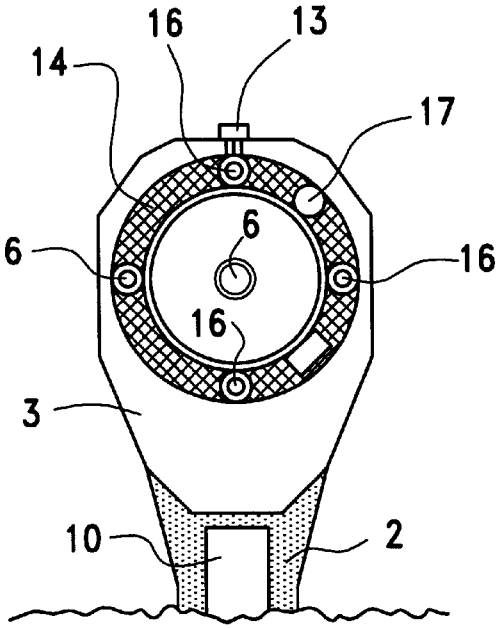
FIG. 2 shows a partial front view of the drill of FIG. 1 without the protective cap of the lighting device.
Figure 3:
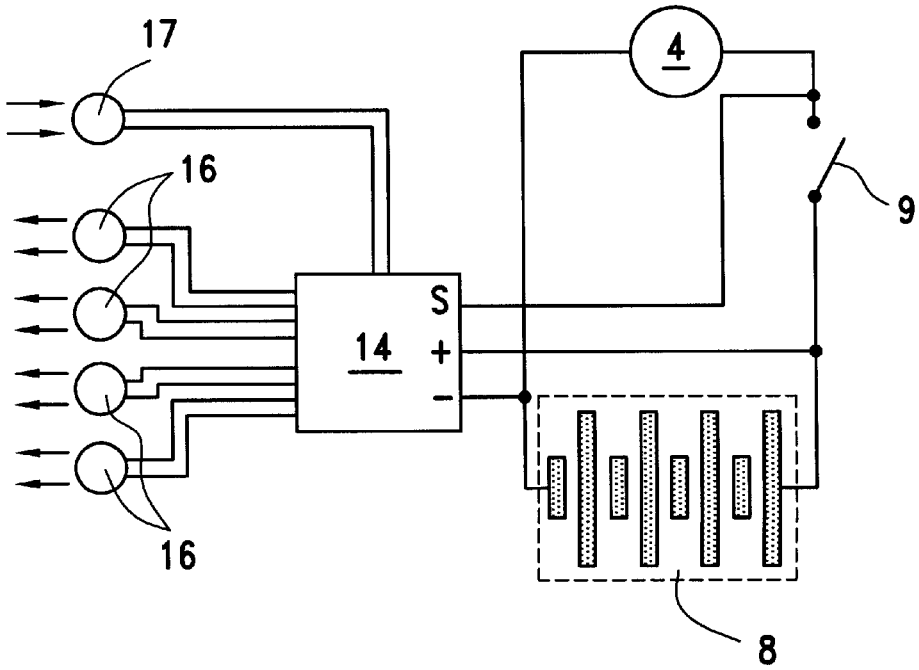
FIG. 3 shows a schematic diagram of the electric circuit of the drill of FIG. 1.

Referring to FIGS. 1 to 3, an electric drill may include outer casing 1, usually made of plastic, which is divided into lower portion 2 acting as a handle and upper portion 3 comprising electric motor 4 and gearing system 5 for driving shaft 6. Various tools or tool bits can be attached to shaft 6 in order to perform various power tool operations. Handle 2 comprises a cavity 7 for housing battery 8 (shown only in FIG. 3) and switch 9 provided with button 10 and connectors 11 coupling switch 9 to battery 8. By pushing button 10 of switch 9, the user can therefore control the power supplied to motor 4 and thus the rotation of shaft 6.

Three electric conductors suitably extend from switch 9 and/or connectors 11, wherein the first conductor is connected to the positive pole of battery 8, the second conductor is connected to the negative pole of battery 8 and the third conductor is connected between the power supply and motor 4. Therefore, a variable voltage is supplied to motor 4 based upon the position of switch 9. These conductors pass through a hole provided in casing 1 and end in a tripolar male connector 12 disposed outside the casing 1. Such an external connector has been provided in known drills and thus, further details concerning the construction of the external connector are not necessary.

Male connector 12 can be coupled to a complementary tripolar female connector 13 arranged at one end of a plurality of conductors terminating at the lighting device in the representative embodiment. This lighting device may comprise an electric circuit 14, and in particular may include a printed circuit board preferably having an annular shape, which is disposed around shaft 6. The printed circuit board may be kept in place by a protective cap 15 having a substantially cylindrical shape, which is fixed to the upper portion 3 of casing 1 of the drill.

A plurality of light emitters 16 and a photometer 17 are disposed on the electric circuit 14 and protrude outside cap 15 through corresponding holes provided in the cap 15.

Figure 4:
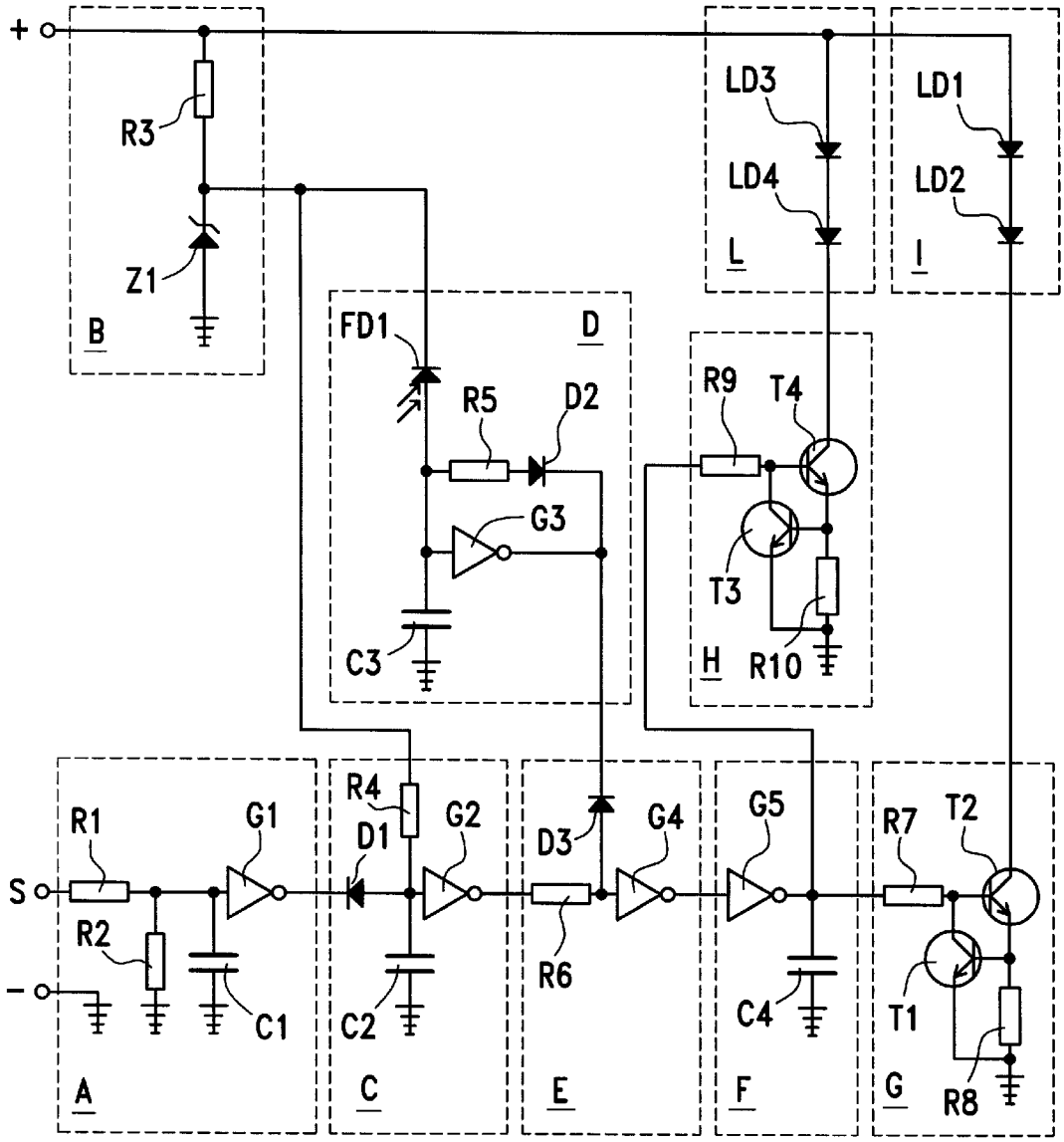
FIG. 4 shows a schematic diagram of the electric circuit of the lighting device of FIG. 1.

Referring now to FIG. 4, electric circuit 14 has a ground terminal extending from the negative pole of battery 8. Terminal S extends from switch 9 and is connected to filter circuit A, which is adapted to eliminate possible spurious pulses caused by this switch. Filter circuit A comprises a resistor R1 connected in series to NOT logic gate G1, as well as resistor R2 and capacitor C1 connected in parallel to ground and disposed between resistor R1 and logic gate G1.

The terminal extending from the positive pole of battery 8 is connected to a voltage limiting circuit B, which may include a resistor R3 and a Zener diode Z1 connected in series to ground. Due to the Zener breakdown voltage of this diode, voltage limiting circuit B supplies a constant voltage, for instance 14 V, irrespective of the voltage of battery 8. Thus, Zener diode Z1 provides a regulated power supply.

A delay circuit C is connected downstream of filter circuit A and voltage limiting circuit B and is adapted to delay the turning off of the light emitters 16 after the power supply to motor 4 has stopped. Delay circuit C may comprise a diode D1 connected to logic gate G1 of circuit A and a resistor R4 connected in series to Zener diode Z1 of circuit B. Diode D1 and resistor R4 are connected to ground via a capacitor C2 and are further connected to a second NOT logic gate G2. The duration of the turning off delay of light emitters 16 is determined by the values of the resistance of resistor R4 and the capacitance of capacitor C2.

A sensor circuit D is connected downstream of voltage limiting circuit B and comprises photometer 17, which may be a photodiode FD1. The photometer 17 is connected to ground via a capacitor C3 and is also connected to a third NOT logic gate G3, as well as to a resistor R5 and to a diode D2 connected in series. Photodiode FD1 is adapted to detect the intensity of ambient visible light. Preferably, photodiode FD1 detects wavelengths of between about 400 and 1100 nm.

A modulator circuit E comprises a diode D3 adapted to modulate the lighting frequency of light emitters 16 according to the ambient light intensity detected by photodiode FD1 of sensor circuit D. Diode D3 is connected to logic gate G3 and diode D2 of sensor circuit D. Modulator circuit Ed also may comprise a resistor R6 connected to gate G2 of delay circuit C, as well as to diode D3 and to a fourth NOT logic gate G4.

A buffer memory circuit F is connected downstream of logic gate G4 of modulator circuit E and may comprise a NOT logic gate G5, the output of which is connected to ground via a capacitor C4.

Two on/off circuits G and H are connected in parallel to the output of logic gate G5, both respectively comprising a pair of BJT transistors T1, T2 and T3, T4 which are biased in a known manner by a pair of resistors R7, R8 and R9, R10. Resistors R8 and R10 are connected to ground. Circuits G and H control the turning on and off of light emitters 16 according to the signal output from logic gate (5. In the present embodiment, light emitters 16 are divided into two lighting circuits I and L, both comprising a pair of light emitting diodes, respectively LD1, LD2 and LD3, LD4, connected in series. Circuits I and L are arranged in parallel between the terminal extending from the positive pole of battery 8 and the collectors of transistors T2 and T4 of on/off circuits G and H, respectively. In the present embodiment light emitting diodes LD1, LD2, LD3 and LD4 consist of high luminosity diodes of about 3 cd each. NOT logic gates G1, CT2, 63, G4 and G5 may be known CMOS integrated circuits, which comprise 6 NOT logic gates and is powered by the output of voltage limiting circuit B.

The following table lists the characteristics of the components used in the lighting device according to the representative embodiment:

TABLE 1

| Component List | | | | | |
|---|---|---|---|---|---|
| Resistors | | | | | |
| R1: 100 KΩ | R2 1 MΩ | R3: 1 KΩ | R4, R5: 4, 7 MΩ | R6, R7, R9: 22 KΩ | R8, R10: 22 KΩ |
| Capacitors | | | | | |
| C1, C4: 100 nF | | | C2: 4, 7 μF | C3: 1 nF | |
| Diodes | | | | | |
| Z1: 14 V | D1, D2, D3: IN4148 | | FDI: SFH203 | LD1, LD2, LD3, LD4: L5W53N | |
| Transistors | | | | | |
| T1, T2, T3, T4: NPN | | | | | |
| Integrated Circuits | | | | | |
| G1, G2, G3, G4, G5: CD 40106 | | | | | |

The part numbers for Diodes FD1 and LD1, LD2, LD3 and LD4 are part numbers of Siemens. The part number for Integrated Circuits G1, G2, G3, G4 and G5 is a part number of Fairchild.

This representative power tool can be operated as follows. After battery 8 has been inserted into housing 7, the user can turn on motor 4 of the drill by pushing button 10 of switch 9. Thus, an electric voltage is transmitted to terminal S of filter circuit A of the electric circuit 14, which is already powered by the positive and negative terminals connected to battery 8. Filtered by circuit A, said signal passes through delay circuit C and is transformed by modulator circuit E into a square wave. The frequency of the square wave changes from about 20 Hz to about 20 kHz according to the ambient light intensity detected by photodiode FD1 of sensor circuit D.

The on/off signal, generated by modulator circuit E and held by buffer memory circuit F, is then transmitted to on/off circuits G and H, which from time to time turn on and off the diodes of circuits I and L according to said signal. Therefore, if the ambient light intensity is high, the light emitting diodes LD1, LD2, LD3 and LD4 turn on and off with a low frequency, so that also the illumination directed to the working point is low. On the other hand, if the ambient light intensity is low, said diodes turn on and off with a high frequency, so that also the illumination directed to the working point is high. When button 10 is released, the light continues to shine on the working area for a certain period of time, due to delay circuit C.

While the present embodiment relates to lighting devices have been applied to portable electric drills powered by a battery, it is obvious that other embodiments of the present invention can relate to lighting devices applied to power tools of another types, such as for instance screwdrivers or other machine tools. Furthermore, if necessary, the power tools can be powered by an alternating current supplied by an external electric source, for example by a socket of an electric network, instead of a continuous current supplied by a battery. In this case, power tool may include a transformer and/or a voltage rectifier, if a transformer and/or a voltage rectifier have not already been provided in the power tool. Also, those skilled in the art will recognize that a variety of controllers can be utilized to control the operating of the light emitters based upon the output of the ambient light detector, and the present teachings are not limited to the specific controller taught in the representative example.

Other teachings relevant to the present teachings can be found in U.S. Pat. No. 6,318,874, which patent has the same assignee as the present application and is hereby incorporated by reference in its entirety.

What is claimed is:

1. A power tool comprising:

a housing;

a motor disposed within-the housing, a tool operably coupled to the motor, at least one light emitter adapted to light a work area around the tool, at least one light detector, wherein the at least one light emitter and the at least one light detector are disposed on the housing, and a controller adapted to receive signals from the at least one light detector and control the operation of the at least one light emitter in accordance with ambient light intensity detected by the at least one light detector.

2. A power tool as in claim 1 further comprising a sensor circuit having at least one photodiode, the sensor circuit adapted to control the light intensity of the light emitter.

3. A power tool as in claim 2, further comprising a modulator circuit coupled to the sensor circuit, the modulator circuit adapted to modulate the lighting frequency of the light emitter in accordance with the ambient light intensity detected by the light detector.

4. A power tool as in claim 3 further comprising a buffer memory circuit coupled to the modulator circuit and at least one on/off circuit coupled to the buffer memory circuit, each on/off circuits comprising at least one transistor adapted to turn the light emitter on and off.

5. A power tool as in claim 1 further comprising a printed circuit board having a substantially annular shape, wherein the light emitter and the light detector are disposed on the printed circuit board.

6. A power tool as in claim 5 further comprising a protective cap disposed on the housing, the cap having holes adapted for the light emitter and the light detector, wherein the printed circuit board is disposed between the cap and the housing.

7. A power tool as in claim 6 wherein the light emitter comprises at least one light emitting diode.

8. A power tool as in claim 7 further comprising a sensor circuit having at least one photodiode, the sensor circuit adapted to control the light intensity of the light emitters.

9. A power tool as in claim 8, further comprising a modulator circuit coupled to the sensor circuit, the modulator circuit adapted to modulate the lighting frequency of the light emitter in accordance with the ambient light intensity detected by the light detector.

10. A power tool as in claim 9 further comprising a buffer memory circuit coupled to the modulator circuit and at least one on/off circuit coupled to the buffer memory circuit, each on/off circuits comprising at least one transistor adapted to turn the light emitter on and off.

11. A power tool as in claim 10 further comprising at least one terminal for connection to a switch and means for controlling the lighting of the light emitter according to the voltage sensed at the terminal.

12. A power tool as in claim 11 wherein the means for controlling the lighting of the light emitter comprises at least one delay circuit.

13. A power tool as in claim 12 further comprising a positive terminal and a negative terminal for the connection through a pair of conductors to a electric power source.

14. A power tool as in claim 13 further comprising a voltage limiting circuit adapted to limit the voltage of the electric power source.

15. A power tool comprising:

a housing, a motor disposed within the housing, a tool operably connected to the motor, at least one light emitter adapted to light a work area around the tool, at least one light detector, wherein the at least one light emitter and the at least one light detector are disposed on the housing, and a controller adapted to receive signals from the at least one light detector and adjust light output of the at least one light emitter in inverse proportion to ambient light intensity detected by the light detector.

16. A power tool as in claim 15 further comprising a printed circuit board having a substantially annular shape, wherein the light emitter and the light detector are disposed on the printed circuit board.

17. A power tool as in claim 16 further comprising a protective cap disposed on the housing, the cap having a plurality of holes adapted for the light emitter and the light detector, wherein the printed circuit board is disposed between the cap and the housing.

18. A power tool comprising:

a housing having an outer casing, a motor disposed within the outer casing, a tool operably coupled to the motor, a light disposed on the outer casing in a position to light a work area around the tool, an ambient light detector disposed on the outer casing in a position to detect ambient light intensity, and a controller adapted to receive signals from the ambient light detector and adjust light output of the light in inverse proportion to the detected ambient light intensity.

19. A power tool as in claim 18 further comprising a printed circuit board having a substantially annular shape, wherein the light and the ambient light detector are disposed on the printed circuit board.

20. A power tool as in claim 19 further comprising a protective cap disposed on the housing, the cap having holes adapted for the light and the ambient light detector, wherein the printed circuit board is disposed between the cap and the housing.

21. A power tool comprising:

a housing, a motor disposed within the housing, a tool operably driven by the motor and extending from the housing, a light mounted so as to illuminate a work area around the tool, an ambient light sensor mounted in optical communication with a source of ambient light, and a controller adjusting the illumination level of the light in response to signals received from the ambient light sensor.

22. A power tool as in claim 21, wherein the controller adjusts the illumination level of the light in inverse proportion to detected ambient light intensity.

23. A power tool as in claim 21, wherein the light and the ambient light sensor are arranged and constructed so that illumination from the light does not influence the ambient light sensor.

24. A power tool as in claim 21, wherein the light comprises a light emitting diode and the ambient light sensor comprises a photodiode.

25. A power tool as in claim 21, further comprising a printed circuit board having a substantially annular shape, wherein the light and the ambient light sensor are disposed on the printed circuit board.

26. A power tool as in claim 25, wherein the printed circuit board is disposed around the housing and proximal to the tool.

27. A power tool as in claim 21, further comprising means for continuing to illuminate the work area for a period of time after the motor has stopped.

28. A power tool as in claim 21, wherein the tool is a screwdriver.

29. A power tool as in claim 21, wherein the tool is a drill.

30. A power tool comprising:

a housing, a motor disposed within the housing, a motor operably driven by the rod and extending from the housing, a light mounted so as to illuminate a work area around the tool, and means for detecting ambient light around the work area and adjusting the illumination level of the light in response to the detected ambient light.

31. A power tool as in claim 30, wherein the light is illuminated in inverse proportion to the detected ambient light.

32. A power tool as in claim 30, wherein illumination from the light does not influence the means for detecting ambient light.

33. A power tool as in claim 30, wherein the tool is a screwdriver.

34. A power tool as in claim 30, wherein the tool is drill.

35. A power tool as in claim 30, further comprising means for continuing to illuminate the work area for a period of time after the motor has stopped.

* * * * *